US010064713B2

(12) United States Patent
Im et al.

(10) Patent No.: US 10,064,713 B2
(45) Date of Patent: Sep. 4, 2018

(54) FIXING DEVICE FOR ENDOTRACHEAL INTUBATION OF RODENTS

(71) Applicant: Samsung Electronics Co., Ltd., Suwon-si, Gyeonggi-do (KR)

(72) Inventors: Geunho Im, Suwon-si (KR); Junghee Lee, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 52 days.

(21) Appl. No.: 14/652,205

(22) PCT Filed: Nov. 6, 2013

(86) PCT No.: PCT/KR2013/010009
§ 371 (c)(1),
(2) Date: Jun. 15, 2015

(87) PCT Pub. No.: WO2014/092342
PCT Pub. Date: Jun. 19, 2014

(65) Prior Publication Data

US 2015/0327968 A1 Nov. 19, 2015

(30) Foreign Application Priority Data

Dec. 13, 2012 (KR) ..... 10-2012-0145718

(51) Int. Cl.
*A61D 3/00* (2006.01)
*A61D 7/04* (2006.01)

(52) U.S. Cl.
CPC ..... *A61D 3/00* (2013.01); *A61D 7/04* (2013.01); *A61D 2003/003* (2013.01)

(58) Field of Classification Search
CPC ..... A61D 3/00; A61D 2003/003; A61D 7/00; A61D 7/04
(Continued)

(56) References Cited

U.S. PATENT DOCUMENTS 4,378,759 A * 4/1983 Garrett ..... A61D 3/00 119/728
8,844,470 B2 * 9/2014 Rapoport ..... A61D 3/00 119/417
(Continued)

FOREIGN PATENT DOCUMENTS

CA 2920488 A1 * 2/2015 ..... A61M 11/00
FR 2975278 A1 * 11/2012 ..... A61B 6/0407
(Continued)

OTHER PUBLICATIONS

International Search Report PCT/ISA/210 for International Application No. PCT/KR2013/010009 dated Feb. 7, 2014.

*Primary Examiner* — Monica L Williams
*Assistant Examiner* — Aaron M Rodziwicz
(74) *Attorney, Agent, or Firm* — Harness, Dickey & Pierce, P.L.C.

(57) ABSTRACT

A fixing device for endotracheal intubation of rodents is provided. The fixing device includes: a bed configured to place a rodent thereon; a support member attached to an upper end portion of the bed in a transversely movable manner and supporting a gas supply pipe through which an anesthetic gas is supplied to the nose of the rodent; and a fastening member configured to fix the support member to the upper end portion of the bed after an end portion of the gas supply pipe is aligned with the nose of the rodent.

6 Claims, 2 Drawing Sheets

(58) Field of Classification Search
USPC ..... 119/756, 751
See application file for complete search history.

(56) References Cited

U.S. PATENT DOCUMENTS

| | | | | |
|---|---|---|---|---|
| 2009/0151720 | A1* | 6/2009 | Inoue | A22B 3/00 128/203.12 |
| 2009/0223460 | A1* | 9/2009 | Starr | A01K 1/031 119/420 |
| 2009/0324048 | A1* | 12/2009 | Leevy | A61B 5/0059 382/132 |
| 2010/0022866 | A1* | 1/2010 | Feke | A61B 5/0059 600/407 |
| 2010/0269260 | A1* | 10/2010 | Lanz | A61B 5/0555 5/601 |
| 2012/0278990 | A1* | 11/2012 | Lanz | A61B 5/0035 5/601 |
| 2012/0330130 | A1* | 12/2012 | Lanz | A61B 5/0555 600/411 |
| 2013/0123609 | A1 | 5/2013 | Odoj et al. | |

FOREIGN PATENT DOCUMENTS

| | | | |
|---|---|---|---|
| JP | 2004081370 | A | 3/2004 |
| JP | 2006288560 | A | 10/2006 |
| JP | 2008043224 | A | 2/2008 |
| JP | 2010264068 | A | 11/2010 |
| KR | 19930025079 | U | 12/1993 |
| KR | 2019930025079 | | 12/1993 |
| KR | 1019950009863 | A | 4/1995 |
| KR | 19950009863 | A | 11/1995 |

* cited by examiner

[Fig. 1]
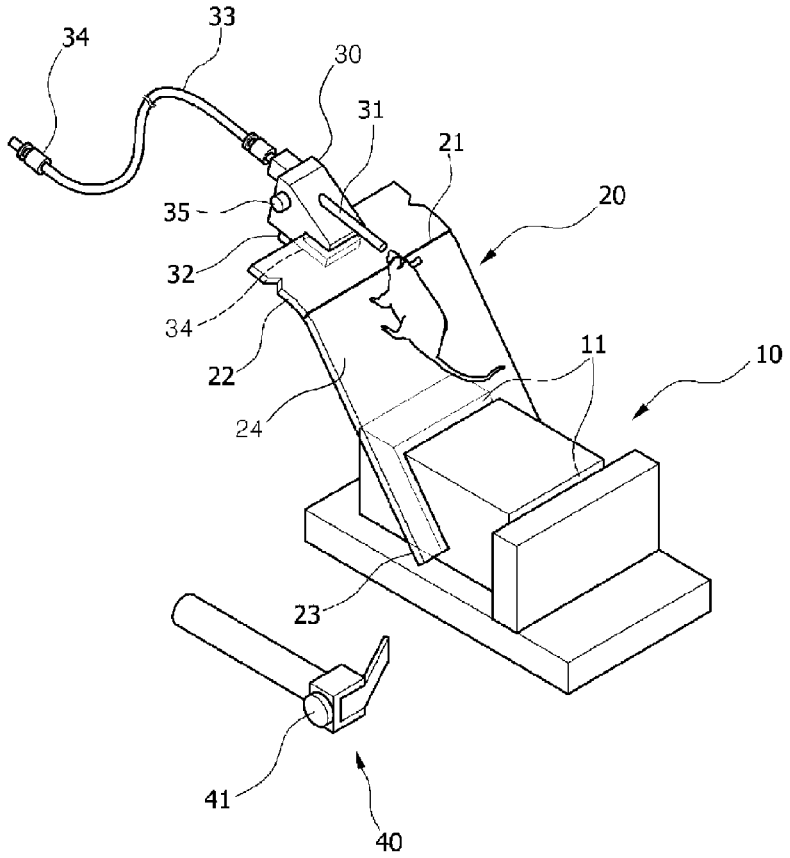

[Fig. 2]
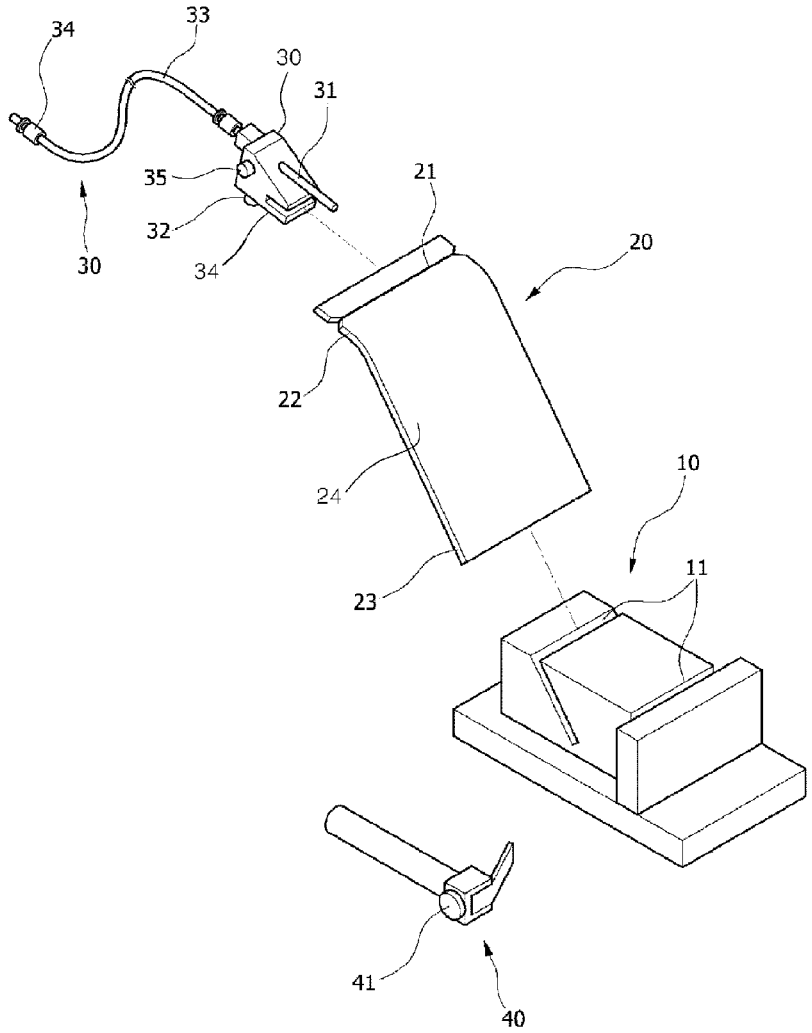

FIXING DEVICE FOR ENDOTRACHEAL INTUBATION OF RODENTS

CROSS-REFERENCE TO RELATED APPLICATIONS

This is a National Phase of PCT/KR2013/010009, filed on Nov. 6, 2013, and claims priority under 35 U.S.C. § 119 to Korean Application No. KR 2012-0145718, filed Dec. 13, 2012.

TECHNICAL FIELD

The present disclosure relates to a fixing device for endotracheal intubation of rodents. More particularly, the present disclosure relates to a fixing device for endotracheal intubation of rodents which includes a fixation adjusting part for fixing an inhalation anesthetizing device to a fixing bed so as to stably maintain anesthesia during intubation.

BACKGROUND ART

Laboratory rodents such as rats and mice are widely used for preclinical animal testing. In operations or experiments using such rodents, a respiratory tube is inserted into the respiratory tract, and a ventilator is connected to the respiratory tube for control breathing and anesthesia.

Mice are exemplary small rodents used for animal testing, and the weight of mice is about 20 g to about 30 g, and the diameter of the respiratory tract of mice is very narrow in the range of 1 mm to 1.5 mm. A tube may be inserted into the respiratory tract of a rodent while looking at the larynx and vocal cord of the rodent using a laryngoscope. However, since the diameter of the respiratory tract of rodents is too small to see, it is difficult for inexperienced experimenters to insert a tube into the respiratory tract of a rodent. In addition, if a rodent is not anesthetized nor in a stable anesthesia state, it is more difficult to insert a tube into the respiratory tract of the rodent because the rodent moves.

DETAILED DESCRIPTION OF THE INVENTION

Technical Problem

A fixing device for endotracheal intubation of rodents is provided so as to fix a rodent at an angle at which intubation may easily be performed.

A fixing device for endotracheal intubation of rodents is provided so as to maintain a rodent at a stable anesthesia state.

Technical Solution

According to an aspect, there is provided a fixing device for endotracheal intubation of rodents, the fixing device including: a bed configured to place a rodent thereon; a support member attached to an upper end portion of the bed in a transversely movable manner and supporting a gas supply pipe through which an anesthetic gas is supplied to a nose of the rodent; and a fastening member configured to fix the support member to the upper end portion of the bed after an end portion of the gas supply pipe is aligned with the nose of the rodent.

The gas supply pipe may be attached to the supporting member and may be movable toward/away from the nose of the rodent, and the fixing device may further include a fixing member configured to fix the gas supply pipe to the supporting member.

The fixing device may further include a head fixing member configured to fix the head of the rodent.

The head fixing member may fix the incisors of the rodent.

The upper end portion may be bent downward from a rest portion of the bed on which the rodent is placed.

The fixing device may further include a base configured to support the bed within an angle range of 45° to 90°.

The base may include a plurality of receiving structures configured to receive a lower end portion of the bed and support the bed at different angles with the angle range.

Advantageous Effects

According to exemplary embodiments, the posture of a rodent may be fixed for stably anesthetizing the rodent and easily performing endotracheal intubation on the rodent.

In addition, even an inexperienced experimenter may stably place a rodent and anesthetize the rodent, thereby reducing the possibility of failure of endotracheal intubation and the time necessary for performing experiments.

DESCRIPTION OF THE DRAWINGS

FIG. 1 is a perspective view illustrating a fixing device for endotracheal intubation of rodents according to an exemplary embodiment.

FIG. 2 is an exploded perspective view illustrating the fixing device for endotracheal intubation of rodents illustrated in FIG. 1, according to an exemplary embodiment.

MODE FOR INVENTION

Hereinafter, a fixing device for endotracheal intubation of rodents will be described in detail with reference to the accompanying drawings according to exemplary embodiments of the present invention. In the drawings, like reference numerals denote like elements. Moreover, detailed descriptions related to well-known functions or configurations will be ruled out in order not to unnecessarily obscure subject matters of the exemplary embodiments.

FIG. 1 is a perspective view illustrating a fixing device for endotracheal intubation of rodents according to an exemplary embodiment, and FIG. 2 is an exploded perspective view illustrating the fixing device for endotracheal intubation of rodents illustrated in FIG. 1, according to an exemplary embodiment.

Referring to FIGS. 1 and 2, the fixing device for endotracheal intubation of rodents includes a bed 20 on which a laboratory rodent may be placed, a base 10 supporting the bed 20 at a predetermined angle, a gas supply pipe 31 for supplying an anesthetic gas, and a support member 30 attached to the bed 20 for supporting the gas supply pipe 31.

The angle of the bed 20 may be determined such that an experimenter may perform endotracheal intubation while looking down at the mouse of a rodent placed on the bed 20. For example, the angle of the bed 20 may be set within the range of about 45° to about 90°. The angle of the bed 20 may be fixed to one value. Alternatively, the angle of the bed 20 may be varied to two or more values.

Referring to FIGS. 1 and 2, the base 10 has two receiving structures 11 into which the bed 20 is insertable. For example, the two receiving structures 11 may have inclined slit shapes respectively capable of holding the bed 20 at 45° and 90°. In FIGS. 1 and 2, two receiving structures 11 are illustrated. However, the number of receiving structures 11 is not limited thereto. For example, the base 10 may include three or more receiving structures 11 for providing three or more bed angles ranging from 45° to 90°.

For example, the bed 20 has a flat plate shape, and a lower end portion 23 of the bed 20 is inserted into one of the receiving structures 11. An experimenter may easily perform endotracheal intubation by selecting one of the receiving structures 11 having a suitable angle after considering factors such as his/her height, and inserting the lower end portion 23 of the bed 20 into the selected receiving structure 11. The depth of each of the receiving structures 11 may be determined in such a manner that after the lower end portion 23 of the bed 20 is inserted into the receiving structure 11, the bed 20 may be stably maintained at the bed angle without separation or falling. Therefore, an additional fixing tool may not be necessary for fixing the bed 20, and thus the fixing device may have a simple structure.

The bed 20 includes a rest portion 24 extending from the lower end portion 23 for receiving a rodent, and an upper end portion 22 opposite the lower end portion 23. The support member 30 is attached to the upper end portion 22. The support member 30 supports the gas supply pipe 31 so that a rodent may enter into a stable anesthesia state before endotracheal intubation. The support member 30 may be moved along the upper end portion 22 in a direction perpendicular to the extending direction of the bed 20. That is, the support member 30 may be moved in a transverse direction. For example, as shown in FIGS. 1 and 2, a rail portion 34 is formed in the support member 30 so that the support member 30 may surround an edge portion of the upper end portion 22 of the bed 20 and may be transversely moved along the upper end portion 22 of the bed 20. For example, the rail portion 34 may have a C-shape. For example, the support member 30 may be moved to a position at which the gas supply pipe 31 supported by the support member 30 is aligned with the nose of a rodent placed on the rest portion 24. In this state, the support member 30 may be coupled to the upper end portion 22 using a fastening member 32. For example, the fastening member 32 may couple the support member 30 to the upper end portion 22 of the bed 20 through a threaded coupling structure. For example, the fastening member 32 having a threaded portion may be inserted into a lower side of the support member 30 toward the upper end portion 22 of the bed 20 so that an end portion of the fastening member 32 may be brought into contact with or held against the upper end portion 22 of the bed 20 for fixing the support member 30 to the upper end portion 22. The fastening member 32 may have a known clamping structure instead of the threaded coupling structure. That is, the fastening member 32 may have any structure as long as the support member 30 may be detachably coupled to the upper end portion 22 of the bed 20 using the fastening member 32.

The gas supply pipe 31 may be coupled to the support member 30 in such a manner that the gas supply pipe 31 may be moved toward and away the nose of a rodent. For example, the gas supply pipe 31 coupled to the support member 30 may be movable forward and backward in the length direction of the gas supply pipe 31. In this case, an end portion of the gas supply pipe 31 may be moved close to the nose of a rodent so as to effectively supply an anesthetic gas and obtain a stable anesthesia state. The gas supply pipe 31 may be movable forward and backward in directions crossing the transverse direction. For example, the gas supply pipe 31 may be inserted into a penetration hole (not shown) of the support member 30, and the penetration hole may have a diameter slightly greater than that of the gas supply pipe 31. For example, the gas supply pipe 31 may be placed at a proper position at which the end portion of the gas supply pipe 31 is close to the nose of a rodent placed on the rest portion 24. In this state, the gas supply pipe 31 may be fixed to the support member 30 using a fixing member 35. For example, the fixing member 35 may have a threaded coupling structure. For example, the gas supply pipe 31 may be fixed to the support member 30 by inserting the fixing member 35 having a threaded coupling structure into a lateral side of the support member 30 until end portion of the fixing member 35 is held against the gas supply pipe 31 disposed in the penetration hole of the support member 30. The fixing member 35 may have a known clamping structure instead of the threaded coupling structure.

For example, the gas supply pipe 31 is connected to an anesthetic gas supply unit (not shown) through a connection tube 33.

The upper end portion 22 of the bed 20 may be bent and extend from the rest portion 24. For example, the upper end portion 22 may be bent at a position corresponding to the mouth of a rodent placed on the rest portion 24. The upper end portion 22 is bent downward from the rest portion 24 so that an experimenter may have a clear view during intubation. If the upper end portion 22 is bent downward, the support member 30 may be outside an intubation path, thereby ensuring a space for intubation and providing a clear view for an experimenter.

A rodent is placed on the rest portion 24. A method for placing a rodent on the rest portion 24 is not limited. For example, any known method may be used. Therefore, a structure for fixing a rodent to the rest portion 24 is not illustrated in FIGS. 1 and 2. For example, the trunk and legs of a rodent may be fixed to the rest portion 24 using an elastic band or a medical sticking plaster.

The fixing device may further include a head fixing member 21 for fixing the head of a rodent to the rest portion 24 when aligning the nose of the rodent with the gas supply pipe 31. The head fixing member 21 may be used to fix a rodent to the rest portion 24 at a position close to the boundary between the upper end portion 22 and the rest portion 24. For example, the head fixing member 21 may be an elastic band disposed across the bed 20 for elastically pushing down the head of a rodent. The head fixing member 21 may be used to fix the incisors of a rodent. Since the incisors of rodents are the frontmost teeth and longer than the other teeth, if the incisors of a rodent are fixed, the rodent may easily be held without being separated upward or downward. For example, the incisors of a rodent may be hooked on an elastic band disposed across the bed 20. In addition, the head fixing member 21 may hold the mouth and upper jaw of the rodent. The head fixing member 21 may be a ring-shaped elastic band fitted around the bed 20. Alternatively, the head fixing member 21 may be an elastic band disposed across the bed 20 with both ends of the elastic band being fixed to the bed 20. Like Velcro, the head fixing member 21 may be fixed to the bed 20. According to the above-described configuration, when a rodent is placed on the rest portion 24 for endotracheal intubation, the mouth of the rodent through which a tube will be inserted and the nose of the rodent to which an anesthetic gas will be supplied are fixed. Therefore, the gas supply pipe 21 may easily be aligned with the nose of the rodent for anesthetizing the rodent, and the endotracheal intubation may easily be performed.

Processes for endotracheal intubation will now be described with reference to FIGS. 1 and 2.

A rodent is placed on the bed 20 supported at a predetermined angle by the base 10. For example, after placing the rodent on the rest portion 24, the trunk and legs of the rodent are fixed to the rest portion 24 using an elastic band or a medical sticking band. In this case, the angle of the bed 20 may be selected or adjusted by inserting the lower end portion 23 of the bed 20 into one of the receiving structures 11. Then, an experimenter may carry out the endotracheal intubation more easily.

Next, the head of the rodent is fixed using the head fixing member 21. At this time, the mouth and nose of the rodent may easily be fixed by fixing the incisors of the rodent.

Next, the support member 30 to which the gas supply pipe 31 is attached is coupled to the upper end portion 22 of the bed 20. At this time, in a state in which the fastening member 32 is not tightened, the support member 30 is transversely moved along the upper end portion 22 to align the gas supply pipe 31 with the nose of the rodent. Thereafter, the fastening member 32 is tightened to fix the support member 30 to the upper end portion 22 of the bed 20.

Next, the gas supply pipe 31 is moved forward or backward in the length direction thereof so as to locate the end portion of the gas supply pipe 31 at a position close to the nose of the rodent. In this state, the gas supply pipe 31 is fixed to the support member 30 using the fixing member 35.

Next, the gas supply pipe 31 is connected to the anesthetic gas supply unit. For example, the connection tube 33 connected to the gas supply pipe 31 is connected to the anesthetic gas supply unit.

Then, the rodent may inhale an anesthetic gas discharged through the end portion of the gas supply pipe 31. After the rodent is stably anesthetized, a respiratory tube (not shown) is inserted into the respiratory tract of the rodent using a laryngoscope 40. Since the diameter of the respiratory tract of rodents is very small, if a detachable magnifier 41 attached to the laryngoscope 40 is used, the endotracheal intubation may be carried out more easily. A ventilator may be connected to the respiratory tube for maintaining the breathing of the rodent.

While the present invention has been shown and described above, it will be apparent to those skilled in the art that modifications and variations could be made without departing from the scope of the present invention as defined by the appended claims. The exemplary embodiments of the present disclosure are for illustrative purposes only and are not intended to limit the scope of the present invention. Therefore, the scope of the invention is defined not by the detailed description but by the appended claims, and all differences within the scope will be construed as being included in the present invention.

INDUSTRIAL APPLICABILITY

The fixing device may be used for endotracheal intubation for maintaining the breathing of rodents or anesthetizing rodents.

The invention claimed is:

1. A fixing device for endotracheal intubation of rodents, the fixing device comprising:

a bed in a first position, the bed having a rest portion configured to place a rodent thereon;

a support member attached to an upper end portion of the bed in a transversely movable manner and supporting a gas supply pipe through which an anesthetic gas is supplied to a nose of the rodent;

a fastening member configured to fix the support member to the upper end portion of the bed after an end portion of the gas supply pipe is aligned with the nose of the rodent; and a base configured to support the bed in the first position, wherein the upper end portion is bent such that, in the first position, the upper end portion does not impede a view of an experimenter during intubation and such that, in the first position, the upper end portion is bend downward and outward from an extending direction of the rest portion of the bed, and a degree to which the upper end portion is bent is fixed.

2. The fixing device of claim 1, wherein the gas supply pipe is attached to the supporting member and is movable toward/away from the nose of the rodent, and the fixing device further comprises a fixing member configured to fix the gas supply pipe to the supporting member.

3. The fixing device of claim 2, further comprising a head fixing member configured to fix the head of the rodent.

4. The fixing device of claim 3, wherein the head fixing member fixes incisors of the rodent.

5. A fixing device for endotracheal intubation of rodents, the fixing device comprising:

a bed having a rest portion configured to place a rodent thereon;

a support member attached to an upper end portion of the bed in a transversely movable manner and supporting a gas supply pipe through which an anesthetic gas is supplied to a nose of the rodent;

a fastening member configured to fix the support member to the upper end portion of the bed after an end portion of the gas supply pipe is aligned with the nose of the rodent; and a base configured to support the bed at a plurality of angled positions including a first position and a second position, wherein the upper end portion is bent such that, in the first position, the upper end portion does not impede a view of an experimenter during intubation and such that, in the first position, the upper end portion is bent downward and outward from an extending direction of the rest portion of the bed.

6. The fixing device of claim 5, wherein the base comprises a plurality of slits having different angles from each other to receive a lower end portion of the bed so as to-support the bed at the different angles.

* * * * *